US007573028B2

(12) United States Patent
Parris et al.

(10) Patent No.: US 7,573,028 B2
(45) Date of Patent: Aug. 11, 2009

(54) ION DRIVE AND ODOR EMITTER

(75) Inventors: Russell Parris, Cambridge (GB); David Ruiz-Alonso, Cambridge (GB); Andrew H. Koehl, Cambridge (GB); Martyn Rush, Cambridge (GB); Paul Boyle, London (GB); Ashley Wilks, Cambridge (GB)

(73) Assignee: Owlstone Nanotech, Inc., New York, NY (US)

( * ) Notice: Subject to any disclaimer, the term of this patent is extended or adjusted under 35 U.S.C. 154(b) by 363 days.

(21) Appl. No.: 11/258,191

(22) Filed: Oct. 26, 2005

(65) Prior Publication Data

US 2007/0090286 A1 Apr. 26, 2007

(51) Int. Cl.
*H01J 49/00* (2006.01)

(52) U.S. Cl. ..... 250/288; 250/281

(58) Field of Classification Search ..... 250/281–300
See application file for complete search history.

(56) References Cited

U.S. PATENT DOCUMENTS 3,639,757 A 2/1972 Caroll et al.
4,960,992 A 10/1990 Vestal et al.
5,433,936 A 7/1995 Ukawa et al.
5,811,820 A * 9/1998 Kirchner et al. ..... 250/432 R
6,495,823 B1 * 12/2002 Miller et al. ..... 250/286
6,642,526 B2 * 11/2003 Hartley ..... 250/423 F
2003/0162072 A1 8/2003 Oosterkamp

* cited by examiner

*Primary Examiner*—David A Vanore
*Assistant Examiner*—Andrew Smyth
(74) *Attorney, Agent, or Firm*—Morgan, Lewis & Bockius LLP

(57) ABSTRACT

The present invention relates to an ion drive for selectively isolating an analyte of interest and methods of use thereof. The ion drive includes a substrate with channels therethrough, a conductive material coating on the bottom and top of the substrate, a top electrical lead connected to the conductive material coating covering the top of the substrate, and a bottom electrical lead connected to the conductive material coating covering the bottom of the substrate. The invention further relates to an odor emitter which is made up of an ion drive mounted towards the top of a vessel.

2 Claims, 4 Drawing Sheets

ION DRIVE AND ODOR EMITTER

BACKGROUND OF THE INVENTION

1. Field of the Invention

The present invention relates to apparatus and methods for isolating an analyte based on odor. More particularly, the invention relates to an ion drive for isolating a volatizable analyte of interest and methods of use thereof.

2. Description of Related Art

Chemicals give off characteristic odors, which can be used to identify the source, including components of a mixture. For instance, humans can identity rotten eggs by the characteristic odor of hydrogen sulfide ($H_2S$).

Odor detection involves the identification of molecules in a gaseous mixture. Thus, the compound to be detected needs to be volatizable, i.e., it needs to evaporate readily at normal temperatures and pressures.

Odor detection is unique in that only small threshold quantity is necessary to detect the presence of an odorous substance. For instance, the human nose has an odor threshold for ammonia of 0.037 parts per million (ppm). Similarly, odor detectors, such as the Dräger bellows sampler pump, allow detection in the ppm range.

In industry and the laboratory, it is extremely useful to isolate chemical substances of interest for further analysis or processing. Thus, selectively extracting one compound from a background of many is a process found in many industries. It usually involves processes that are costly and time consuming. There are numerous techniques to separate components of a mixture, based on the components' properties such as e.g., boiling point, melting point, partial vapor pressure, and molecular weight.

Odor is not one of these properties, yet it is unique in that only a small quantity is required for detection. For example, U.S. application Ser. No. 10/797,466 to Miller et al. teaches that differential ion mobility spectrometry (DMS) analyzer systems may provide for the detection of odors. Miller et al. fail to suggest use of the DMS system for further analysis or for isolation of odorous substances.

There remains a need for a device that allows for selective isolation of an odorous analyte of interest. There further remains the need for such a device that can be used in industrial processing. There also remains a need for an odor isolation system that is cheap to manufacture and efficient to use.

SUMMARY

The present invention is directed to an ion drive and methods of use thereof. The ion drive may be mounted towards the top of a vessel to create an odor emitter.

Additional features and advantages of the invention are set forth in the description, which follows, and will be apparent, in part, from the description, or may be learned by practice of the invention. Certain objectives and other advantages of the invention will be realized and attained by the structure particularly pointed out in the written description and claims hereof, as well as the appended drawings.

An ion drive according to the instant disclosure illustratively comprises: a substrate with a plurality of channels therethrough; a conductive material, such as a metal, coating on the bottom and top of the substrate; a top electrical lead connected to the conductive material coating covering the top of the substrate; and a bottom electrical lead connected to the conductive material coating covering the bottom of the substrate. A direct or alternating current may be applied to the conductive material.

The conductive material may be selected from Pt, Au, Cr, Cu, Ni, Al, Ag, W, and Ti and the substrate may be silicon.

A gas stream may be passed over and parallel to the top side of the substrate. This gas stream carries the analyte of interest after it passes through the channels in the ion drive away for isolation, further processing and/or analysis.

Another embodiment of the invention is an odor emitter illustratively comprising: a vessel with an opening toward the top of the vessel and an ion drive mounted in the opening. The ion drive may include a substrate with a plurality of channels therethrough, a conductive material, such as a metal, coating on the bottom and top of the substrate, a top electrical lead connected to the conductive material covering the top of the substrate, and a bottom electrical lead connected to the conductive material covering the bottom of the substrate, wherein the bottom of the ion drive faces the inside of the vessel and the top of the ion drive faces the outside of the vessel.

The vessel may further include a heater and an exhaust. Preferably, the exhaust is mounted below the top of the vessel but above the level of solution in the vessel. When the vessel includes an exhaust, a counterflow of gas may be applied from the top of, through the channels, and out of the bottom of the ion drive. Use of the counterflow and exhaust aids in isolation accuracy.

An alternating current may be applied to the conductive material on the top and bottom of the ion drive's substrate. Also, a gas flow may be passed over and parallel to the top side of the ion drive.

The odor emitter may further include second ion drive of similar structure mounted inline and in series with the first ion drive.

Another embodiment of the invention is a method of isolating an analyte of interest. This method illustratively has, the steps: (1) providing an ion drive, wherein the ion drive includes a substrate with a plurality of channels therethrough, a conductive material coating on the bottom and top of the substrate, a top electrical lead connected to the conductive material coating covering the top of the substrate, and a bottom electrical lead connected to the conductive material coating covering the bottom of the substrate; (2) providing a sample containing an analyte of interest and placing sample below the bottom of the ion drive; (3) volatizing the analyte; and (4) isolating the analyte of interest by passing the volatilized analyte of interest through the ion drive. The step of volatizing the analyte may be carried about by heating the sample, e.g., to a temperature from about 20° C. to about 150° C., or by pressurizing the sample, e.g., between about 1.5 atm and about 5 atm. The step of isolating the analyte may employ use of a gas flow parallel to and over the top side of the ion drive or use of a counterflow from the top of, through the channels, and out of the bottom of the ion drive.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

The present invention is directed to an ion drive and odor emitter to selectively isolate analytes of interest and methods of use thereof.

1. Definitions

"Volatile" as used herein shall mean evaporate readily at normal temperatures and pressures. "Volatizable" means being able to evaporate at normal temperatures and pressures. "Volatize" means to evaporate readily at normal temperatures and pressures.

"Odor emitter" as used herein shall mean a vessel with an ion drive mounted in an opening of the vessel towards the top of the vessel.

"Analyte of interest" as used herein shall mean the substance that was targeted for isolation via use of an ion drive.

2. General Description of Embodiments of the Invention

Reference will now be made in detail to the preferred embodiments of the present invention, examples of which are illustrated in the accompanying drawings.

Figure 1:
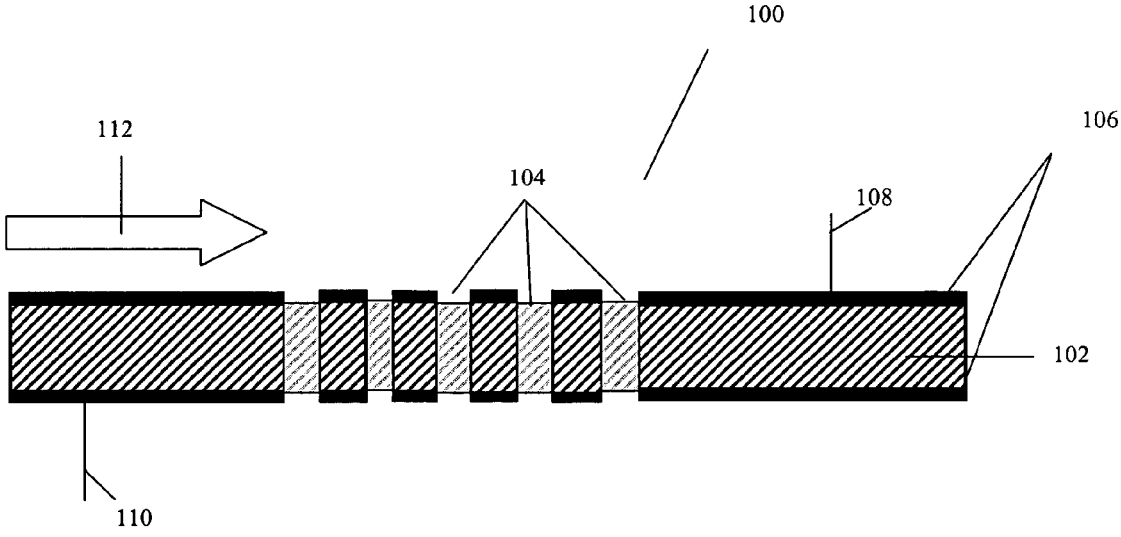
FIG. 1 is a cross-sectional diagram of the ion drive according to one embodiment of the invention.

FIG. 1 is a cross-sectional diagram of ion drive 100 according to one embodiment of the invention. The ion drive 100 includes a substrate 102 with channels 104 running between the top and bottom major surface. The top surface and bottom surface of substrate 102, but not the channels 104, are coated with conductive material 106. Top electrical lead 108 is connected to the conductive material 106 on the top of side of the substrate 102. Bottom electrical lead 110 is connected to the conductive material 106 at the bottom side of the substrate 102. Electrical leads 108 and 110 provide for the passing of current through the conductive material 106 on the top and bottom of substrate 102, respectively. Gas flow 112 flows over the top of the top side of the ion drive. Gas flow 112 carries the analyte of interest away for downstream processing and/or analysis.

An ion drive according to the instant disclosure has the ability to isolate a variety of analytes of interests. Furthermore, the ion drive advantageously allows for micro-purification, i.e., isolation of analytes of interest present only in ppm or smaller quantities. Thus, the ion drive is very useful in both the laboratory and industry.

Due to its structure, the ion drive is cheap to manufacture, particularly, when compared to conventional devices for isolation of an analyte of interest.

The substrate serves as a mechanical platform to hold the conductive material and electrodes. It may be any rigid, micro-machinable, electrically insulating material. Preferably, the substrate is substantially planar. Also preferably, the substrate is high-resistivity silicon. Other insulators well known in the microelectronic process arts are also suitable, such as e.g., gallium arsenide.

The substrate may have a thickness from about 10 μm to about 1000 μm, alternatively from about 25 μm to about 100 μm, alternatively from about 75 μm to about 200 μm, alternatively from about 150 μm to about 265 μm, alternatively from about 230 μm to about 400 μm, alternatively from about 300 μm to about 500 μm, alternatively from about 420 μm to about 730 μm, alternatively from about 700 μm to about 850 μm, alternatively from about 815 μm to about 925 μm.

The conductive material may be deposited on the surface of the substrate by semi-conductor manufacturing techniques such as e.g., photolithographic techniques. In one embodiment of the invention, a different conductive material is used on the top and the bottom of the substrate.

Furthermore, the conductive material may be made of any material that conducts electricity. Similarly, the electrical leads may be made of any material conducting electricity. In some embodiments, the conductive material and electrical leads may be Pt, Au, Cr, Cu, Ni, Al, Ag, W, Ti, or other materials conducting electricity that may be sputtered, chemical vapor deposited or electroplated onto the substrate.

The channels shown in FIG. 1 may take a variety of shapes such as e.g., cylindrical, square holes, and serpentines. The channels may be created by deep-etching and should have lateral dimensions sufficient for the analyte of interest to be able to pass through. In some embodiments, the channel may have lateral dimensions from about 5 μm to about 50 μm.

The electrical leads are each connected to a power supply, which applies a different voltage to the conductive material coating the top and the bottom of the substrate. The potential drop between the top and bottom of the substrate result in a longitudinal electric field that drives ions through the ion drive. The power supply creates both a longitudinal and a transverse electric field. The longitudinal field may be created by DC voltage and the transverse electric field may be created by AC voltage. Preferably, an alternating potential is applied to the conductive material coating the top and bottom of the substrate.

The amount of voltage applied varies depending on the ion of interest. Given an analyte of interest, one skilled in the art will be able to determine the proper voltage to be applied. In some embodiments, the power supply applies from about 0 V to about 50 V.

Gas flow 112 serves to carry the substrate of interest away from the ion drive. Preferably, the gas flow may be of inert gas. The amount of gas flow may be varied, via the use of e.g., a valve, depending on the analyte of interest.

In one embodiment of the invention, the gas flow carries a sample of the analyte of interest to a downstream detector, to verify that the analyte of interest has been isolated. This detector may be a field asymmetric ion mobility spectrometer, or an ion mobility spectrometer.

Figure 2:
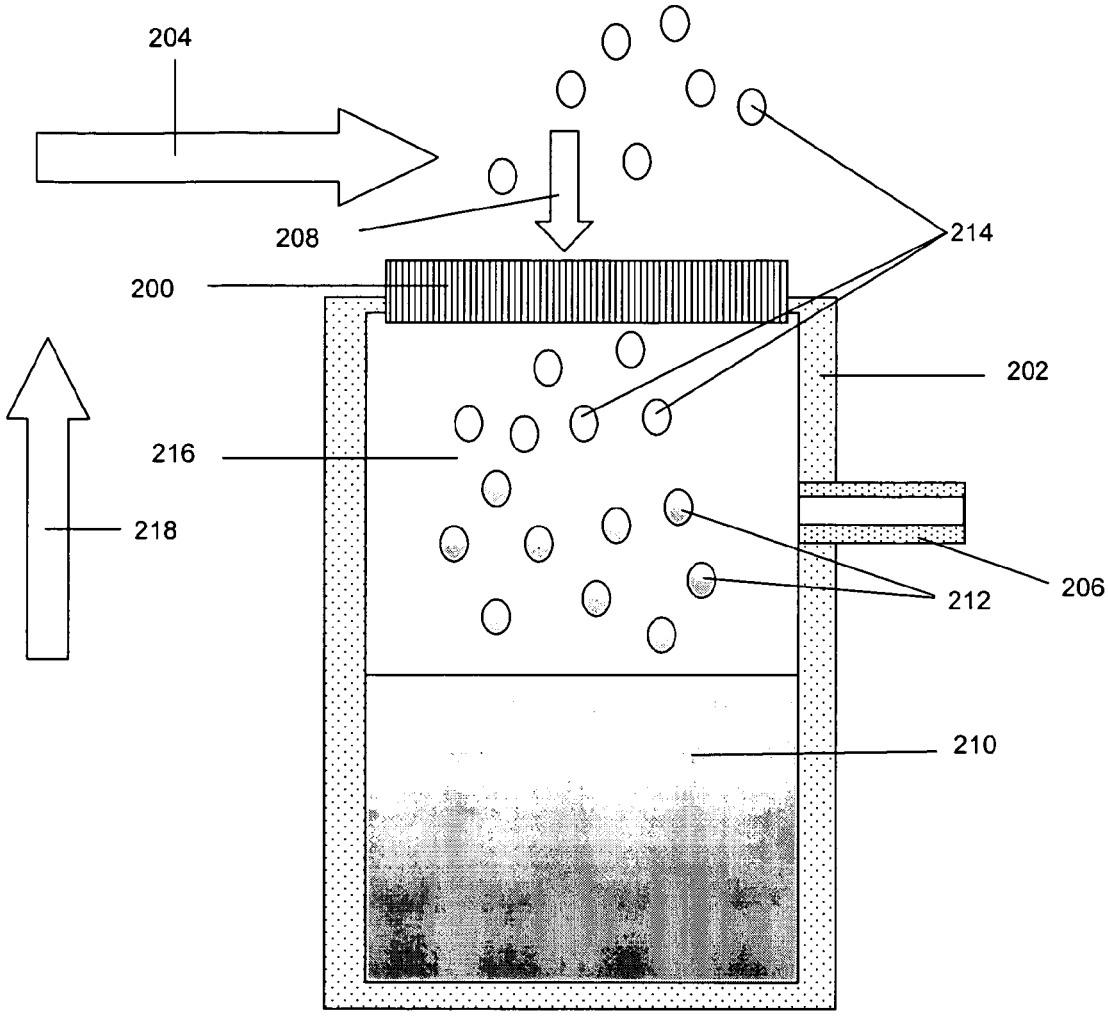
FIG. 2 is a cross-sectional diagram of another embodiment of the invention.

The ion drive is mounted towards the top of a vessel, i.e., any container that can hold a solution containing the analyte of interest, thereby creating an odor emitter. FIG. 2 is a cross-sectional diagram of one embodiment of the invention where the ion drive 200 is mounted towards the top of a vessel 202. Gas flow 204 passes over the top of ion drive 200, which is on the outside of vessel 202. Current is applied to the ion drive to create both a longitudinal and a transverse electric field. The vessel contains a solution 210 with a volatizable analytes, including the analyte of interest. As the analytes are volatized, the volatized analyte 212 and volatized target analyte of interest 214 travel to the headspace 216 of the vessel, with the flow of the volatized analytes indicated by arrow 218. Because of the longitudinal and transverse electric field, only ions with the proper charge, i.e., the volatized target analyte of interest 214, are accelerated through the ion drive and out of the vessel. Non-target volatized ions 212 cannot pass through the ion drive. After leaving the ion drive, the volatized target analyte of interest 214 is carried by gas flow 204 for isolation, further processing and/or analysis.

The vessel may further contain exhaust 206. The exhaust may be used to control the concentration of volatized analyte in the ionization region below the bottom of the ion drive. Preferably, the exhaust is mounted below the top of the vessel but above the level of solution in the vessel.

When the vessel has exhaust 206, it may further have counterflow 208 passing from the outside of the vessel, through the channels in the ion drive 200, towards the inside of the vessel. The counterflow 208 has to be non-reactive with the analyte of interest and preferably is an inert gas. Use of the counterflow, in the direction opposite of ion flow, optimally increases the selectivity of the ion drive for the analyte of interest and helps to ensure that unwanted compounds remain in the headspace of the vessel. The amount of counterflow may be varied based on the target analyte of interest.

An ion drive according to the instant disclosure advantageously does not cause fluidic impedance and has a low pressure drop across it. Hence, a variety of vessels are suitable for use with the ion drive.

The vessel may be made of may be made of any suitable material, such as e.g., glass, ceramic, plastic or stainless steel.

The ion drive 200 may be mounted directly to the top of the vessel. Alternatively, the ion drive is mounted to the vessel via use of an adapter. When the vessel is made of an electro-conductive material such as stainless steel, the ion drive should be attached to the top of the vessel via use of an adapter made up of an insulator. Using the ion drive with an adapter allows retrofitting the ion drive to an existing vessel with an opening. To simplify retrofitting, the power supply may be a battery.

As long as there is target analyte that can be volatized, the ion drive provides for continuous isolation of an analyte of interest. Thus, to ensure a continuous supply of analyte the vessel 202 may optionally further have an intake port for the addition of solution, which may have a valve.

The analyte may be volatized by heat or pressure. To optimize volatilization and hence isolation, the vessel 202 may also further be heated or contain an agitator, or both. Alternatively, the vessel is temperature controlled by heating or cooling the vessel so that the solution is kept at the volatilization temperature of the target analyte of interest. This temperature control may be achieved by using a conventional thermostat.

In one embodiment, a selectively opening valve is attached to the side of the ion drive facing the vessel. This allows use of one vessel for first reacting two compounds while keeping the valve closed and then subsequently opening up the valve and the isolating the product by via of use the ion drive.

Figure 3:
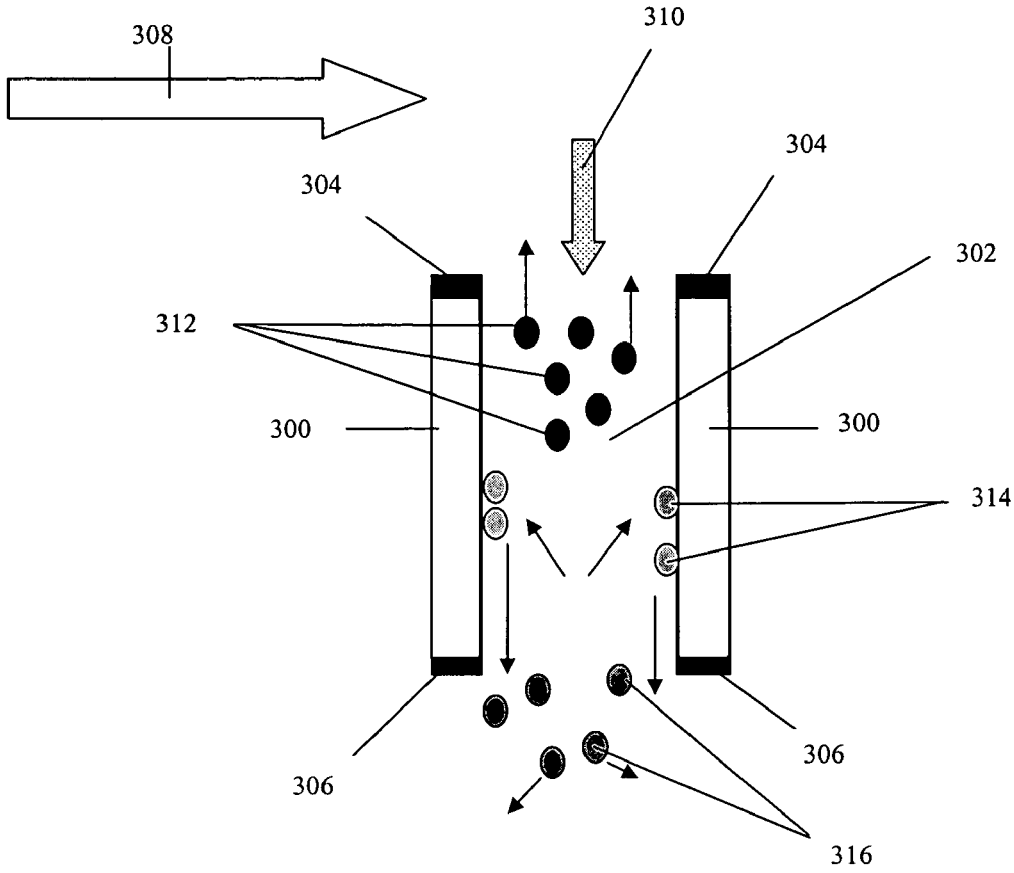
FIG. 3 is a cross-sectional diagram of a channel in an ion drive with an optional counterflow applied over the ion drive according to one embodiment of the invention.

FIG. 3 is a cross-sectional diagram of an ion drive with an optional counterflow applied over the ion drive according to one embodiment of the invention. A channel 302 of an ion drive is shown. The ion drive is made up of substrate 300 with top electro-conductive material 304 on the top side of the substrate and bottom electro-conductive material 306. Both top electro-conductive material 304 and bottom electro-conductive material 306 are each connected to a power supply that is applying a voltage. Gas flow 308 is passed over the top of the ion drive and optional counterflow 310 is passed from the top of the ion drive through the channel in the ion drive and out the bottom, in a direction opposite to ion flow. As a voltage is applied to the ion drive, the analyte of interest, in this case negatively charged analyte of interest 312, moves from the ionization region through the ion drive. The counterflow 310 and the longitudinal electric field prevent ions of the opposite charge, in this case positively charged ions 316, from entering the ion drive. Ions that are of similar charge as the target analyte of interest loose their charge on the walls of the ion drive and are hence do not pass through the ion drive. Thus, negatively charged ions 314 loose their charge on the walls of channel 304 and are swept out of the ion drive by counterflow 310.

In one embodiment of the invention, two ion drives are mounted in series with and inline with each other. This advantageously allows for the isolation of two analytes of interest and subsequent selective mixing.

In another embodiment of the invention, a detector is mounted inside the vessel of the odor detector. This detector detects the presence of the analyte of interest by such techniques as field asymmetric ion mobility spectrometry (FAIMS) or ion mobility spectrometry (IMS). Upon the detection of the analyte of interest, the detector passes a signal to a processor which in turn optimizes the amount of voltage applied to the ion drive to maximize isolation of the analyte of interest.

Another embodiment of the invention is a method of isolating an analyte of interest via use of an ion drive. The method has the steps of: (1) providing an ion drive wherein the ion drive includes a substrate with a plurality of channels therethrough, a conductive material coating on the bottom and top of the substrate, a top electrical lead connected to the conductive material coating covering the top of the substrate; and a bottom electrical lead connected to the conductive material coating covering the bottom of the substrate; (2) providing a sample containing an analyte of interest and placing sample below the bottom of the ion drive; (3) volatizing the analyte; and (4) isolating the analyte of interest by passing the volatilized analyte of interest through the ion drive.

The step of volatizing the sample may be achieved through a variety of means such as heating the sample or pressurizing the sample. In one embodiment, the sample is volatized by heating it to temperatures from about 20° C. to about 150° C., alternatively from about 25° C. to about 65° C., alternatively from about 26° C. to about 80° C., alternatively from about 60° C. to about 150° C. In another embodiment of the invention, the sample is volatized by pressurizing the sample to about 1.5 atm to about 5 atm, alternatively to about 1.5 atm to about 4.5 atm.

The step of isolating the analyte of interest is achieved by applying both a longitudinal and a transverse electric field across the channel to only allow the analyte of interest to pass through the channels. The longitudinal field may be created by a DC offset voltage and the transverse electric field may be created by an RF waveform. In one embodiment of the invention, the step of isolating the analyte of interest is carried out by applying an alternating current to the ion drive.

The step of isolating the analyte of interest may includes passing a gas flow parallel to and over the top side of the ion drive. This gas flow carries the analyte of interest away from the ion drive for isolation, further processing and/or analysis.

The step of isolating the analyte may include a counterflow of gas from the top of, through the channels, and out of the bottom of the ion drive. Use of a counterflow further improves the ability of the ion drive to analyze the analyte of interest.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

EXAMPLE 1

Figure 4:
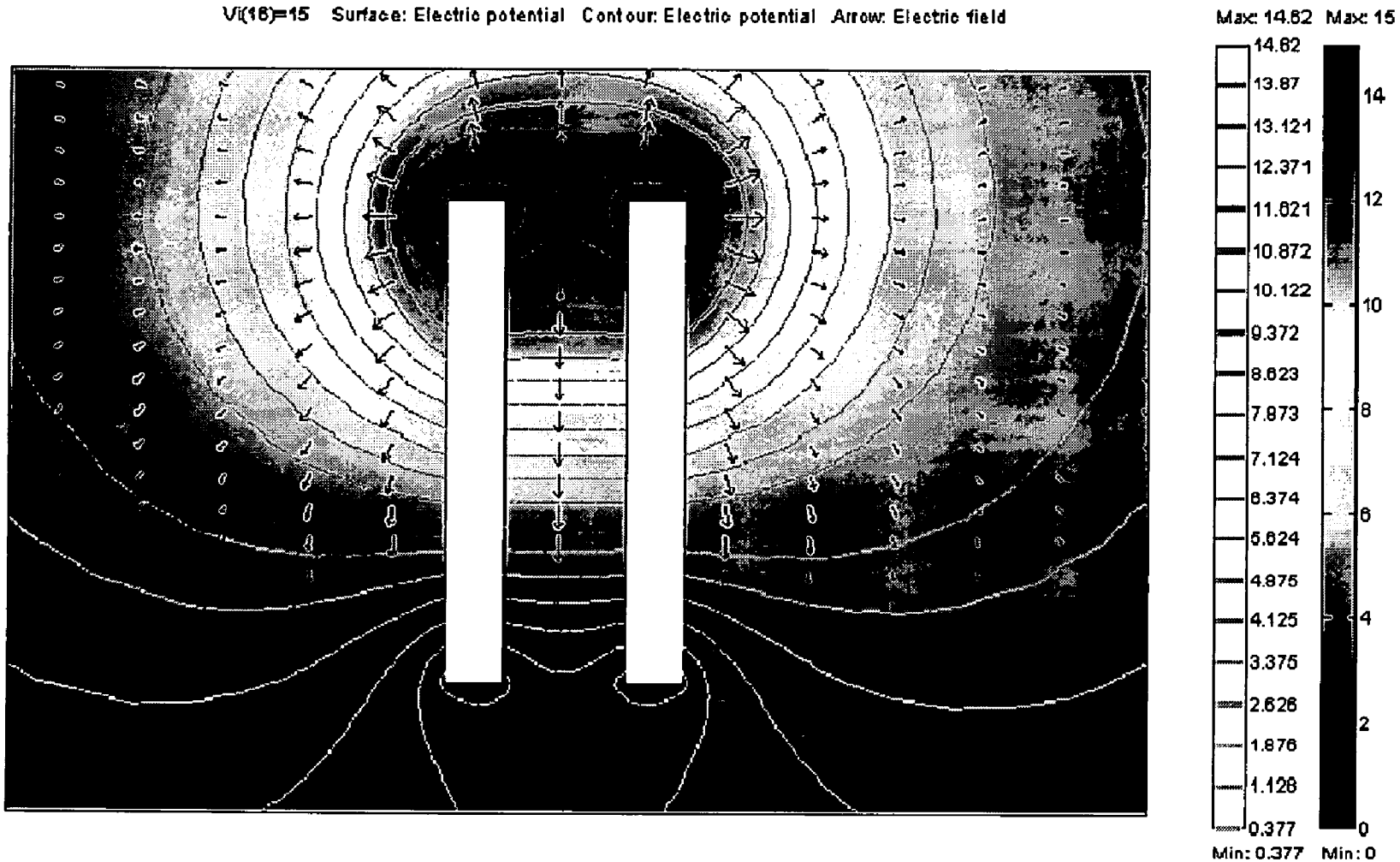
FIG. 4 is computer simulation illustrating the ion drift across a channel for an ion drive according to one embodiment of the invention.

FIG. 4 is a finite element simulation of the ion drift through an ion drive according to the instant disclosure. As is evidenced from FIG. 4, as a voltage is applied across the ion drive, an electric field is created. Depending on the charge, ions may be driven through the channel by the ion drive. This illustrates that analytes of interest can be isolated via use of an ion drive.

The invention claimed is:

1. An odor emitter comprising:

a vessel with an opening toward the top of the vessel; and an ion drive mounted in the opening, wherein the ion drive comprises:

a substrate with a plurality of channels therethrough, a conductive material coating on the bottom and top of the substrate, a top electrical lead connected to the conductive material covering the top of the substrate, a bottom electrical lead connected to the conductive material covering the bottom of the substrate, wherein the bottom of the ion drive faces the inside of the vessel and the top of the ion drive faces the outside of the vessel; and an exhaust mounted below the top of the vessel and above a level of solution in the vessel.

2. The odor emitter of claim 1 wherein the ion drive further comprises a counterflow of gas applied from the top of the ion drive, through the channels of the ion drive and out the bottom of the ion drive.

* * * * *